US006793694B2

(12) United States Patent
Schulz et al.

(10) Patent No.: US 6,793,694 B2
(45) Date of Patent: Sep. 21, 2004

(54) TEMPERATURE-STABLE EMULSIFIED FUEL

(75) Inventors: Philippe Schulz, Ste Foy les Lyon (FR); Laurent Dalix, Lyons (FR); Frédéric Tort, Brignais (FR)

(73) Assignee: Elf Antar France, Puteaux (FR)

( * ) Notice: Subject to any disclaimer, the term of this patent is extended or adjusted under 35 U.S.C. 154(b) by 0 days.

(21) Appl. No.: 10/149,862

(22) PCT Filed: Dec. 12, 2000

(86) PCT No.: PCT/FR00/03483

§ 371 (c)(1),
(2), (4) Date: Jul. 18, 2003

(87) PCT Pub. No.: WO01/48123

PCT Pub. Date: Jul. 5, 2001

(65) Prior Publication Data

US 2004/0107633 A1 Jun. 10, 2004

(30) Foreign Application Priority Data

Dec. 23, 1999 (FR) ..... 99 16380

(51) Int. Cl.[7] ..... C10L 1/32
(52) U.S. Cl. ..... 44/301; 44/302
(58) Field of Search ..... 44/301, 302

(56) References Cited

U.S. PATENT DOCUMENTS

| | | | | | |
|---|---|---|---|---|---|
| 4,877,414 | A | | 10/1989 | Mekonen | |
| 6,068,670 | A | * | 5/2000 | Haupais et al. | 44/301 |
| 6,280,485 | B1 | * | 8/2001 | Daly et al. | 44/301 |
| 6,638,323 | B2 | * | 10/2003 | Tsai et al. | 44/301 |

FOREIGN PATENT DOCUMENTS

| | | |
|---|---|---|
| WO | WO/97/34969 | 9/1997 |
| WO | WO 98/31773 | 7/1998 |

* cited by examiner

*Primary Examiner*—Cephia D. Toomer
(74) *Attorney, Agent, or Firm*—Townsend and Townsend and Crew LLP

(57) ABSTRACT

The invention provides an emulsified fuel containing a major portion of hydrocarbon liquid and a minor portion of water, containing a set of additives including an emulsifying system comprising from 2.5 to 3.5 parts by weight of at least one sorbitol ester, from 1.5 to 2.5 parts by weight of at least one polyalkoxylated fatty acid ester and from 0.5 to 2.0 parts by weight of at least one polyalkoxylated compound selected from di- and tri-alkylated iso alcohols, the HLB of the emulsifying system varying from 6 to 8.

Additive compositions are also provided.

36 Claims, No Drawings

TEMPERATURE-STABLE EMULSIFIED FUEL

The present invention relates to emulsified fuels which are temperature stable up to above 70° C. and down to less than −10° C., in particular automobile fuels intended for use in internal combustion engines. More precisely, the fuels envisaged here contain a major part of a liquid hydrocarbon, and notably:

- those of inorganic origin such as petroleum derivatives of the gasoline, gas-oil, kerosene, fuel-oil type and/or such as derivatives of coal or gas (synthetic fuels).
- those of vegetable origin such as vegetable oils and esters thereof,
- and their mixtures, to which optionally oxygenated compounds such as the mono-and poly-alcohols have been added.

The present invention more specifically covers the composition of the fuels constituted by water/liquid hydrocarbon emulsions, preferably water/Diesel fuel emulsions, that are economically valuable and which limit problems of environmental pollution. Below, we shall discuss stabilised water/hydrocarbon emulsions, comprising surfactants suitable for favoring and maintaining the emulsions stable for temperature variations between −10° C. and greater than 70° C.

Water very quickly appeared to be a valuable additive or partial substitutuent for gasoline or Diesel fuel, as it is inexpensive and non-toxic, allowing reduction of specific fuel consumption and emission of poluants whether visible or not.

Despite all these presumed advantages, very few water/hydrocarbon fuels have been produced industrially and distributed on a wide scale to fuel consumers.

Among all the tests carried out, it has been envisaged to provide for separate storage of water and automobile fuel on the vehicle, for mixing prior to injection into the running engine. This approach required a complex and sophisticated device for mixing and metering out each component of the mixture to be implemented on board the vehicle. It became clear that the cost, bulk and fragility of such devices made development of this approach completely dissuasive.

A second approach consisted in storing the pre-metered mixture of water and fuel, but the distributor soon encountered problems of stability during storage of such mixtures in the temperature ranges varying from −20° C. to 70° C., and the automobile owner met with the problems of stability of this mixture in the gasoline tank.

Consequently, numerous fruitless technical propositions exist which in vain set out to provide emulsified fuels comprising water and, more generally, new and non-polluting fuels, leading to a low specific consumption.

As illustration of this state-of-the-art, we can cite French Patent application 2,470,153 which discloses an emulsified fuel, comprising hydrocarbons, and water, and alcohol (methanol, ethanol) and an emulsifying system formed by sorbitan mono-oleate and by ethoxylated nonylphenol. The concentration of the emulsifying system in the emulsion is comprised between 3 and 10% by volume. The indispensable presence of alcohol in this emulsion, constitutes an extremely penalizing element, notably in view of the economies and engine performance obtainable with this emulsion. Additionally, it should be noted that the stability of this water-alcohol/hydrocarbon emulsion has not demonstrated its effectiveness. Indeed, after 72 hours storage of the emulsion, corresponding to a realistic period of non-use of a vehicle operating with this fuel, signs of phase separation (dephasing/demixing) can be seen between the hydrocarbons and the hydro-alcoholic mixture. The de-phased (separated) hydrocarbons at the end of this period can make up up to 3 percent by volume of the emulsion. One can readily imagine that after a few days storage, phase separation of the emulsions in French patent application 2,470,153 will be sufficiently great to make them unsuitable for use, under normal conditions of application.

Additionally, from U.S. Pat. No. 4,877,414, an emulsified fuel is known that includes a certain number of additives, including an emulsifying system formed by a sorbitan sesquioleate, sorbitan mono-oleate, and polyoxyethylene (6 EO) ether of dodecylalcohol. Preferably, according to that patent, total concentration of all additives is around 2.1 percent. Apart from the emulsifying system, the other additives able to be employed can be: a mono-α-olefin (decene-1), methoxymethanol, toluene, and alkyl benzene and calcium hydroxides. This formula is extremely complex, if only in view of the number of additives employed. It is additionally relatively expensive. Finally, the emulsified fuel according to that patent also itself suffers from a lack of stability, particularly at low temperatures. Applicant has further clearly brought this to light by reproducing the preferred example of implementation of the emulsified fuel according to this U.S. patent. It was found that the emulsion separated (suffered phase separation) in one hour. The phenomenon is further accentuated at low temperature, below 5° C. One could hardly dare imagine what could happen in an automobile gasoline tank containing this emulsion under strong winter conditions.

The abstract of Japanese Patent 77-69909 given in Chemical Abstracts 87: 138513 x, relates to an emulsified fuel (kerosene:water) comprising sorbitan sesquiolate and polyethylene glycol ether of nonylphenol as emulsifiers. The size of the dispersed aqueous phase is $\leqq 20\ \mu m$ and, on average, is of the order of $10\ \mu m$. This technical proposition also does not provide a suitable way of satisfying the objectives of physico-chemical stability, limitation of pollution, economy and reduction of fuel consumption. That technical teaching consequently in no way helps the skilled person in his investigative work on this invention.

A further Chemical Abstract No. 101: 57568 z, summarizing Brazilian Patent 82 4 947 covers an emulsified fuel comprising hydrocarbons constituted by extremely viscose and heavy petroleum derivatives, water, ethanol and an emulsifier constituted by ethoxylated nonylphenol. This emulsified fuel is intended for use in ovens, conventional fuel oil burners. This fuel could not meet the expected performance specifications for combustion, pollution limitation and low consumption in light or heavy vehicle internal combustion engines. Additionally, this emulsion has poor physico-chemical stability.

International application WO 97/34969, in the name of the applicant, discloses emulsified fuels which the present invention sets out to improve.

These emulsified fuels, which can be automobile fuels, comprise specific amounts of hydrocarbon and a minor amount of a set of additives including, notably, an emulsifying system comprising at least one sorbitol ester, at least one polyalcoxylated fatty acid ester of HLB greater than or equal to 9, and at least one polyalcoxylated alkylphenol of HLB comprised between 10 and 15, the respective concentration ratios of these components varying from 2.5–3.5; 1.5–2.5; 0.5–1.9. The dispersed phase of these emulsified fuels is constituted by water present in an amount of 5–35% by weight while the additives are present in amount of 0.1 to 2% by weight. These fuels are particularly stable over storage times of at least three months. Nevertheless, it has been noted that when used in vehicles in which the fuel gets heated up prior or during the injection phase, before introduction into the carburettor, and when a portion is sent back to the gasoline tank after passage through a filter reaching temperatures close to 75° C., the emulsified fuel separated out into two water and hydrocarbon phases. Thus, a bus which had been stopped over the weekend could not start again on the Monday morning, all of the fuel having decanted. This decantation phenomenon of the emulsified fuels is accentuated when a high-pressure supply system is used, favoring temperature increase. In particular, in all the new direct injection diesel engine technologies equipping all new heavy goods vehicles and an increasingly large percentage of new light vehicles, fuels are heated to a temperature greater than 70° C.

The performance of these known emulsified fuels, in terms of temperature stability towards temperatures greater than 75° C. and also at −20° C. can most certainly be improved to provide answers to the problems associated with their use under real conditions in a vehicle.

The present invention provides an emulsified fuel that is stable for at least four days at more than 70° C., fuel stability when cold, in other words at −10° C. or, yet again, during storage at up to 40° C. being maintained over at least three months without untimely decantation. Additionally, the invention sets out to obtain an emulsified fuel which meets all government requirements as regards the environment. Thus, this involves, in particular, replacing the polyalcoxylated alkylphenols used in numerous emulsified fuels but which are not accepted by all administrations, by a compound or mixture of compounds which allow not only the same stability during storage for the emulsion to be obtained but which also provides improved stability at a temperature greater than 70° C., and also good stability in use over a simulated cycle between −10 and +20° C.

The present invention consequently provides an emulsified fuel containing a major portion of hydrocarbon liquid and a minor portion of from 5 to 35% by weight water, containing a set of additives including an emulsifying system comprising:

i) from 2.5 to 3.5 parts by weight of at least one sorbitol ester of formula (I) below:

(I)

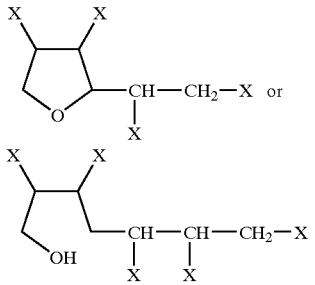

in which the radicals X are identical or different and each correspond to a group selected from $OR_1$ groups, $R_1$ being hydrogen or an aliphatic radical having 1–6 carbon atoms, and a $R_2$—COO— group where $R_2$ is hydrogen or a linear or branched, saturated or unsaturated aliphatic hydrocarbon radical, optionally substituted by at least one hydroxylated group and having 6–22 carbon atoms, at least one X radical corresponding to $R_2$—COO—, ii) from 1.5 to 2.5 parts by weight of at least one polyalkoxylated fatty acid ester of formula (II) below:

(II)

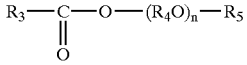

in which $R_3$ is a linear or branched, saturated or unsaturated aliphatic hydrocarbon radical, optionally substituted by at least one hydroxylated group and having from 6 to 22 carbon atoms, $R_4$ is a linear or branched alkylene group having from 1 to 10 carbon atoms, preferably 2 to 3 carbon atoms, n is an integer greater than or equal to 6, preferably varying between 6 and 30, and $R_5$ is hydrogen, a linear or branched alkyl group having 1 to 10 carbon atoms, or is:

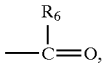

$R_6$ being identical to or different from $R_3$, iii) from 0.5 to 2.0 parts by weight of at least one polyalkoxylated compound of general formula (III) below;

(III)

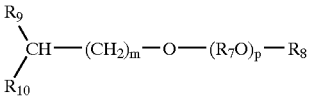

in which $R_9$ and $R_{10}$ are identical or different, linear or branched alkylene groups having 1–20 carbon atoms, $R_7$ is linear or branched alkylene having 1 to 10 carbon atoms, preferably 1 to 3 carbon atoms, $R_8$ is selected in the group consisting of hydrogen, linear or branched alkylene groups having 1 to 10 carbon atoms, and

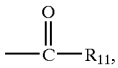

$R_{11}$ being a linear or branched, saturated or unsaturated aliphatic radical, optionally substituted by hydroxylated functions and having 6–22 carbon atoms, m and p are integers varying respectively from 0–20 and from 3–10, the HLB of the emulsifying system varying from 6 to 8.

It has been noticed that, unexpectedly, introducing the compound of formula (III) in combination with the mixture of compounds of formula (1) and formula (II) considerably increased stability of emulsified fuel when the latter was maintained for more than three days, or sporadically, at temperatures greater than 50° C. and even greater than 75° C., compared to the closest prior art constituted by International application WO 97/34969. In effect, the emulsion as implemented previously does separate into two phases as soon as the emulsion is brought to more than 50° C. for more than 24 hours.

In parallel, stability in use and stability during storage of the emulsions according to the invention are maintained, compared to the state-of-the-art.

Such temperature stability greater than three days is obtained by introducing the emulsifying system at a concentration of at the most 2% by weight into the emulsified fuels. Obviously, it is always possible to introduce more emulsifying system into the fuel, but this is not necessary.

Among the compounds of formula (I), the preferred sorbitol esters are chosen from sorbitol oleates alone or in a mixture, sorbitol sesquioleate being preferred.

The fatty acid esters of formula (II) are selected from oleates, stearates and ricinoleates of polyethylene glycol. The preferred esters are those in which the polyethylene glycol fraction has a molecular weight less than or equal to 600, and preferably less than 450.

The polyalkoxylated compounds of formula (III) which ensure, in combination with the two other components of the emulsifying system, hot fuel stability, are chosen from di- and tri-alkylated iso alcohols, each alkyl radical having 1–15 carbon atoms, preferably from alcohols the alkyl radicals of which comprise from 5 to 12 carbon atoms. Preferably, they are chosen among iso tridecylic alcohols comprising from 3–10 ethoxylated groups.

In the present invention, the hydrocarbonated liquid constituting the major proportion of the fuel is chosen from the group consisting of gasolines, medium distillates, synthetic fuels, animal or vegetable oils, whether or not esterified, and mixtures thereof.

The emulsified fuel according to the invention additionally comprises, apart from the hydrocarbon phase, water and the emulsifying system, further additives such as cetane-improvers preferably chosen from peroxides and/or nitrates and mixtures thereof, and, optionally, a metallic catalyst for soot post-combustion, said metal being one of those of the group constituted by magnesium, calcium, cerium, copper, iron or mixtures thereof. It can contain, further, a biocide, preferably a bactericide and/or a fungicide, and also an anti-freeze, in the aqueous phase.

For use as an emulsified fuel, the fuel according to the invention can contain usual additives such as filterability additives, cloud point improvers, lubricity and anti-sedimentation additives, anti-wear agents, anti-foaming agents, anti-corrosion agents, detergent additives, and/or additives or additive compositions for improving cold flow properties.

Among these additives, we can particularly mention:

a) cetane-improver additives, notably (but not in a limiting way) chosen from alkyl nitrates, preferably 2-ethyl hexyl nitrate, aryl peroxides, preferably benzyl peroxide, and alkyl peroxides, preferably ter-butyl peroxide.

b) filterability additive, notably (but not in a limiting way) chosen from ethylene/vinyl acetate (EVA) copolymers, ethylene/vinyl propionate (EVP), ethylene/vinyl ethanoate (EVE), ethylene/methyl methacrylate (EMMA), and ethylene/alkyl fumarate. Examples of such additives are given in European Patent application 0187488, French Patent 2,490,669, European patent applications 0722481, and 0832172.

c) anti-foaming additive, notably (but not in a limiting way) chosen from polysiloxanes, oxyalkylated polysiloxanes, and fatty acid amides of vegetable or animal oil origin. Examples of such additives are given in European patent applications 0861182, 0663000, 0736590.

d) detergent and/or anti-corrosion additives, notably (but not in a limiting manner) chosen in the group consisting of amines, succimides, alkenylsuccinimides, polyalkylamines, polyalkyl polyamines and polyetheramines. Examples of such additives are given in European patent application 0938535.

e) lubricity or anti-wear additive, notably (but not in a limiting way) selected in the group constituted by fatty acids and their ester or amide derivatives, notably glycerol mono-oleate and derivatives of mono- and poly-cyclic carboxylic acids. Examples of such additives are given in: European patent applications 0680506, 0860494, International application WO/98 04656, European patent application 0915944, French Patents 2,772,783 and 2,772,784.

f) cloud point additive, notably (but not in a limiting manner) selected from the group consisting of long chain olefin/(meth)acrylic ester/maleimide terpolymers and ester derivatives of fumaric/maleic acids. Examples of such additives are given in European patent applications 0071513, 0100248, French Patents 2,528,051 and 2,528,423, European patent applications 0112195, 0172758, 0271385 and 0291367.

g) anti-sedimentation additive, notably (but not in a limiting way) selected in the group consisting of copolymers of (meth)acrylic acid/alkyl (meth)acrylate amidified by a polyamine, polyamine alkenyl succinimides, derivatives of phthalamic acid and double chain fatty amine. Examples of such additives are given in European patent applications 0261959, 00593331, 0674689, 0327423, 0512889 and 0832172.

h) cold flow properties polyfunctional additive chosen in the group consisting of olefin-based polymers and alkenyl nitrate as described in French patent application serial No. 99. 12549 of 8th Oct. 1999.

The invention also provides a composition of additives for a fuel containing essentially an emulsifying system and, optionally, at least one further additive selected from the compounds of the group consisting of cetane-improvers, combustion and soot combustion catalytic promoters, biocides, anti-freezes, detergents, lubricity additives, anti-wear additives, anti-foaming additives, anti-corrosion additives and additives or additive compositions for improving cold (flow) properties.

The examples below are given by way of illustration of the invention without limiting the scope thereof.

EXAMPLE 1

This present example sets out to give the results for stability of the emulsified fuels of the invention, compared to results for the known art.

There was consequently prepared, using methods described in International application WO 97/34969, several emulsions the compositions of which differed by the composition of their emulsifying system.

For the purposes of comparison, a standard formulation was used for all the emulsions examined, obtained with a type EN 590 reference diesel fuel:

13% by weight water containing biocide (2% by volume of the diesel fuel) and, optionally, 10% by weight monoethyleneglycol in winter formulations 1% by volume of diesel fuel of an organic biocide 1.86% by weight of an emulsifying system and 1% by weight of a cetane-improver additive the remaining percentage by weight being the diesel fuel.

Emulsifying system compositions are given in Table 1 below:

TABLE 1

| | Surfactant composition | | | | | | | | | | | | | | |
|---|---|---|---|---|---|---|---|---|---|---|---|---|---|---|---|
| | A | B | C | D | E | F | F' | G | H | I | J | K | L | M | N |
| Sorbitan sesquiolate | 3 | 3 | | | 1.5 | 3 | 3 | | | | | 1.5 | 1.5 | 1 | 3 |
| Sorbitan monooleate | | | 3 | 3 | 1.5 | | | 1.5 | 1.5 | 1.5 | | | | | |
| Sorbitan laurate | | | | | | | | | | | | 1.5 | | | |
| Sorbitan stearate | | | | | | | | | | | | | 1.5 | | |
| PEG 300 | | | | | | | | 1 | | | | | | | |
| PEG 6E0 monooleate | 2 | | | | | | | | | | | 2 | 2 | 2 | |
| PEG 7.4EO monooleate | | 2 | 2 | 2 | 2 | 2 | 2 | | | | | | | | 2 |
| PEG 600 monooleate | | | | | | | | | 1 | | | | | | |
| Ethoxylated nonylphenol 9EO | | 1 | | 1 | 1 | | | 1 | | | | | | 3 | |
| Ethoxylated nonylphenol 12EO | | | | | | | | | | 1 | | | | | |
| Ethoxylated nonylphenol 30EO | | | | | | | | | | | 1 | 1.5 | 1.5 | | |
| Ethoxylated decylic alcohol 3EO | | | | | | | | | | | | | | | 1 |
| Ethoxylated isotridecylic alcohol 7.5EO | 1 | | 1 | | | 1 | 1 | | | | | | | | |
| HLB of emulsifying system | 7.2 | 7.5 | 7.6 | 7.6 | 7.6 | 7.6 | 7.6 | 8.2 | 10.1 | 8.1 | 9.2 | 9.6 | 9.6 | 10.1 | 7 |

In this table, compositions A, C and F are compositions according to the invention, compositions B, D, E and N are comparative examples.

Emulsion quality was evaluated on the basis of granulometry, storage stability regardless of ambient temperature, stability in use, stability in storage and temperature stability.

By image analysis from micrographs, the homogeneous appearance of the water droplets dispersed in the continuous diesel fuel phase was characterised per their mean particle size and their distribution.

Emulsions stability in use was characterised by an absence of demixing/decantation or other breakage of emulsion in a 1 liter beaker, that had undergone a stimulation cycle corresponding to the presumed recirculation cycle of a diesel fuel in an automobile fuel tank.

By the term stimulating cycle, we mean a temperature cycle consisting in:

bringing a sample down to a temperature of −10° C. over one hour increasing sample temperature from −10° C. to +40° C. over 1 hour, and then dropping this temperature to +10° C. over three hours, finally, bringing the temperature down to −10° C. over 7 hours and keeping the sample at this temperature for one hour.

We consider that demixing occurs during this stimulating cycle when, at the end of the cycle, the volume of supernatant liquid, the decanted diesel fuel, is greater than 5% by volume of the total sample volume or, yet again, when water appears at the bottom of the beaker.

Storage stability is determined by absence of demixing/decantation after three months static storage in conical flasks, of three samples kept at, respectively, 0° C., 20° C. and 40° C.

In this case, demixing is characterised by separation into two separate phases which are not necessarily transparent.

Hot stability is characterised by a complete absence of demixing/decantation after four days static storage at 75° C.

For this latter stability, demixing is characterised by separation into two transparent phases.

Stabilities were evaluated by the extent of time separating preparation of the emulsion and the time demixing/decantation occurred. Depending on stability, this time is measured in hours (h), days (d), weeks (w) and months (m).

The complete results are given in Table II below.

TABLE II

| | Composition surfactants | | | | | | | | | | | | | | |
|---|---|---|---|---|---|---|---|---|---|---|---|---|---|---|---|
| | A | B | C | D | E | F | F' | G | H | I | J | K | L | M | N |
| Formulation Specific additive | summer | summer | summer | summer | summer | summer | winter | summer | summer 7% MeOH | summer 7% MeOH | summer 7% MeOH | summer | summer | Summer | summer |
| Dispersity granulometry (d) | mono 1 μm | mono 1 μm | mono 1 μm | mono 1 μm | mono 1 μm | mono 1 μm | mono 1 μm | poly 1–10 μm | poly 1–20 μm | poly 1–20 μm | poly 1–20 μm | poly 1–20 μm | poly 1–20 μm | poly 1–20 μm | poly 1–20 mm |
| Stability in use | yes | yes | yes | yes | yes | yes | yes | no | no | no | no | no | no | no | no |

TABLE II-continued

| | Composition surfactants | | | | | | | | | | | | | | |
|---|---|---|---|---|---|---|---|---|---|---|---|---|---|---|---|
| | A | B | C | D | E | F | F' | G | H | I | J | K | L | M | N |
| Stability in storage | | | | | | | | | | | | | | | |
| 0° C., | | 4 w | | 4 w | 4 w | | | 1 h | 1 h | 1 h | 1 h | 1 h | 1 h | 1 h | 2 h |
| 20° C., | 3 m | 3 m | 3 m | 3 m | 3 m | 3 m | 3 m | 2 w | 1 d | 1 d | 1 d | 2 h | 2 h | 2 h | 4 h |
| 40° C. | | 3 m | | 3 m | 3 m | | | 1 d | 1 h | 1 h | 1 h | 1 h | 1 h | 1 h | |
| hot stability 75° C. | 3 w | 1 w | 3 w | 1 w | 1 w | 3 w | 2 w | 1 h | 1 h | 1 h | 1 h | 1 h | 1 h | 1 h | 1 h |

It is seen from this table that stability in use and stability in storage of emulsifying systems A, C, F, and F' according to the invention are preserved when compared to emulsifying systems B, D, E and N according to International application WO 97/34969. Temperature stability is however greatly improved. It is also seen that the two formulations of the emulsifying systems according to this present application and to International application WO 97/34969 are much better than formulations G to M.

What is claimed is:

1. An emulsified fuel containing a major portion of hydrocarbon liquid and a minor portion of from 5 to 35% by weight water, containing a set of additives including an emulsifying system comprising:

i) from 2.5 to 3.5 parts by weight of at least one sorbitol ester of formula (I) below:

(I)

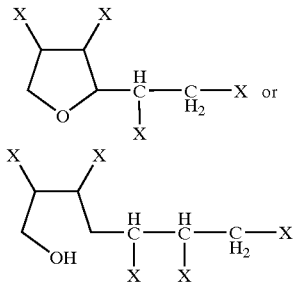

in which the radicals X are identical or different and each correspond to a group selected from $OR_1$ groups, $R_1$ being hydrogen or an aliphatic radical having 1–6 carbon atoms, and a $R_2$—COO— group where $R_2$ is hydrogen or a linear or branched, saturated or unsaturated aliphatic hydrocarbon radical, optionally substituted by at least one hydroxylated group and having 6–22 carbon atoms, at least one X radical corresponding to $R_2$—COO—, ii) from 1.5 to 2.5 parts by weight of at least one polyalkoxylated fatty acid ester of formula (II) below:

(II)

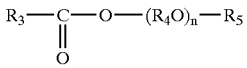

in which $R_3$ is a linear or branched, saturated or unsaturated aliphatic hydrocarbon radical, optionally substituted by at least one hydroxylated group and having from 6 to 22 carbon atoms, $R_4$ is a linear or branched alkylene group having from 1 to 10 carbon atoms, n is an integer greater than or equal to 6, and $R_5$ is hydrogen, a linear or branched alkyl group having 1 to 10 carbon atoms, or is:

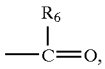

$R_6$ being a linear or branched, saturated or unsaturated aliphatic hydrocarbon radical, optionally substituted by at least one hydroxylated group and having from 6 to 22 carbon atoms, iii) from 0.5 to 2.0 parts by weight of at least one polyalkoxylated compound of general formula (III) below;

(III)

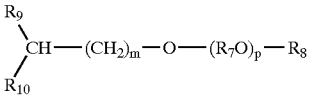

in which $R_9$ and $R_{10}$ are identical or different, linear or branched alkylene groups having 1–20 carbon atoms, $R_7$ is linear or branched alkylene having 1 to 10 carbon atoms, $R_8$ is selected in the group consisting of hydrogen, linear or branched alkylene groups having 1 to 10 carbon atoms, and

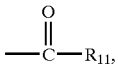

$R_{11}$ being a linear or branched, saturated or unsaturated aliphatic radical, optionally substituted by hydroxylated functions and having 7–22 carbon atoms, m and p are integers varying respectively from 0–20 and from 3–10, the HLB of the emulsifying system varying from 6 to 8.

2. The fuel according to claim 1, characterised in that emulsifying system concentration is less than or equal to 2% by weight.

3. The fuel according to claim 1, characterised in that the sorbitol esters of formula (I) are chosen from sorbitan oleates alone or in mixture.

4. The fuel according to claim 2, characterised in that the sorbitol esters of formula (I) are chosen from sorbitan oleates alone or in mixture.

5. The fuel according to claim 1, characterised in that the fatty acid esters of formula (II) are chosen from oleates, stearates and ricinoleates of polyethyleneglycol, the esters optionally being those of which the polyethyleneglycol fraction has a molecular weight less than or equal to 600.

6. The fuel according to claim 2, characterised in that the fatty acid esters of formula (II) are chosen from oleates, stearates and ricinoleates of polyethyleneglycol, the esters optionally being those of which the polyethyleneglycol fraction has a molecular weight less than or equal to 600.

7. The fuel according to claim 1, characterised in that the polyalkoxylated compounds of formula (III) are selected from di- and tri-alkylated iso alcohols, each alkyl radical having 1–15 carbon atoms.

8. The fuel according to claim 2, characterised in that the polyalkoxylated compounds of formula (III) are selected from di- and tri-alkylated iso alcohols, each alkyl radical having 1–15 carbon atoms.

9. The fuel according to claim 8, characterised in that the polyalkoxylated compounds of formula (III) are isotridecylic alcohols having 3–10ethoxylated groups.

10. The fuel according to claim 1, characterised in that the sorbitol esters of formula (I) are chosen from sorbitan oleates alone or in mixture;

the fatty acid esters of formula (II) are chosen from oleates, stearates and ricinoleates of polyethyleneglycol, the esters optionally being those of which the polyethyleneglycol fraction has a molecular weight less than or equal to 600;

the polyalkoxylated compounds of formula (III) are selected from di- and tri-alkylated iso alcohols, each alkyl radical having 1–15 carbon atoms.

11. The fuel according to claim 2, characterised in that the sorbitol esters of formula (I) are chosen from sorbitan oleates alone or in mixture;

the fatty acid esters of formula (II) are chosen from oleates, stearates and ricinoleates of polyethyleneglycol, the esters optionally being those of which the polyethyleneglycol fraction has a molecular weight less than or equal to 600;

the polyalkoxylated compounds of formula (III) are selected from di- and tri-alkylated iso alcohols, each alkyl radical having 1–15 carbon atoms.

12. The fuel according to claim 1, characterised in that the hydrocarbon liquid is selected in the group consisting of gasolines, middle distillates, synthetic fuels, animal or vegetable oils whether esterified or not, and mixtures thereof.

13. The fuel according to claim 10, characterised in that the hydrocarbon liquid is selected in the group consisting of gasolines, middle distillates, synthetic fuels, animal or vegetable oils whether esterified or not, and mixtures thereof.

14. The fuel according to claim 11, characterised in that the hydrocarbon liquid is selected in the group consisting of gasolines, middle distillates, synthetic fuels, animal or vegetable oils whether esterified or not, and mixtures thereof.

15. The fuel according to claim 1, characterised in that it comprises cetane-improver additives, selected from peroxides and/or nitrates and mixtures thereof and, optionally, a metallic catalyst for soot post-combustion, said metal being one of those of the group constituted by magnesium, calcium, barium, cerium, copper, iron or mixtures thereof.

16. The fuel according to claim 10, characterised in that it comprises cetane-improver additives, selected from peroxides and/or nitrates and mixtures thereof and, optionally, a metallic catalyst for soot post-combustion, said metal being one of those of the group constituted by magnesium, calcium, barium, cerium, copper, iron or mixtures thereof.

17. The fuel according to claim 14, characterised in that it comprises cetane-improver additives, selected from peroxides and/or nitrates and mixtures thereof and, optionally, a metallic catalyst for soot post-combustion, said metal being one of those of the group constituted by magnesium, calcium, barium, cerium, copper, iron or mixtures thereof.

18. The fuel according to claim 1, characterised in that the aqueous phase contains a biocide, a bactericide and/or a fungicide and, optionally, an anti-freeze.

19. The fuel according to claim 1, characterised in that it includes one or several filterability, cloud point improving, lubricity, anti-sedimentation, anti-wear, anti-foaming, anti-corrosion, or detergent additives and/or additives or compositions of additives for improving cold (flow) properties.

20. An additive composition for a fuel, characterised in that it essentially contains the emulsifying system as defined in claim 1 and, optionally, at least one further additive selected from the compounds of the group consisting of cetane-improvers, combustion and soot combustion catalytic promoters, biocides, anti-freezes, detergents, lubricating additives, anti-wear additives, anti-foaming additives, anti-corrosion additives and additives or additive compositions for improving cold (flow) properties.

21. The fuel according to claim 1, characterised in that $R_4$ is a linear or branched alkylene group having from 2 to 3 carbon atoms.

22. The fuel according to claim 1, characterised in that n is an integer from 6 to 30.

23. The fuel according to claim 1, characterised in that $R_7$ is a linear or branched alkylene having 1 to 3 carbon atoms.

24. The fuel according to claim 3, characterised in that the sorbitan oleate comprises sorbitan sesquioleate.

25. The fuel according to claim 4, characterised in that the sorbitan oleate comprises sorbitan sesquioleate.

26. The fuel according to claim 5, characterised in that the polyethyleneglycol fraction has a molecular weight less than 450.

27. The fuel according to claim 6, characterised in that the polyethyleneglycol fraction has a molecular weight less than 450.

28. The fuel according to claim 7, characterised in that the alkyl radicals comprise 2–12 carbon atoms.

29. The fuel according to claim 8, characterised in that the alkyl radicals comprise 2–12 carbon atoms.

30. The fuel according to claim 10, characterised in that the sorbitan oleate comprises sorbitan sesquioleate.

31. The fuel according to claim 10, characterised in that the polyethyleneglycol fraction has a molecular weight less than 450.

32. The fuel according to claim 10, characterised in that the alkyl radicals comprise 2–12 carbon atoms.

33. The fuel according to claim 11, characterised in that the sorbitan oleate comprises sorbitan sesquioleate.

34. The fuel according to claim 11, characterised in that the polyethyleneglycol fraction has a molecular weight less than 450.

35. The fuel according to claim 11, characterised in that the alkyl radicals comprise 2–12 carbon atoms.

36. The fuel according to claim 20, characterised in that the fuel is a motor fuel.

* * * * *